United States Patent [19]

Broadwell et al.

[11] 4,014,498

[45] Mar. 29, 1977

[54] METHOD AND APPARATUS FOR CENTRIFUGING SLUDGE-CONTAINING LIQUIDS

[75] Inventors: Edward Broadwell, Isleworth; William Charles Thompson, Great Bookham, both of England

[73] Assignee: Alfa-Laval AB, Tumba, Sweden

[22] Filed: Feb. 23, 1976

[21] Appl. No.: 660,730

[30] Foreign Application Priority Data

Feb. 21, 1975 United Kingdom ..... 1746/75

[52] U.S. Cl. ..... 233/20 R

[51] Int. Cl.[2] ..... B04B 11/02

[58] Field of Search ..... 233/19 R, 19 A, 20 R, 233/20 A; 210/78, 89, 110, 138; 127/19, 56

[56] References Cited

UNITED STATES PATENTS

| | | | |
|---|---|---|---|
| 3,126,337 | 3/1964 | Smith | 233/19 R |
| 3,497,386 | 2/1970 | Steele et al. | 233/19 R |
| 3,829,584 | 8/1974 | Seiberling | 233/19 R |
| 3,938,734 | 2/1976 | Wilke | 233/20 R |

*Primary Examiner*—George H. Krizmanich

*Attorney, Agent, or Firm*—Cyrus S. Hapgood

[57] ABSTRACT

When a predetermined amount of separated sludge has accumulated in the peripheral part of the centrifuge rotor, a sensing device automatically opens outlets for the discharge of sludge. To provide substantially constant time intervals between consecutive openings of these sludge outlets, the feed rate to the centrifuge is automatically decreased in response to a shortening of these time intervals and automatically increased in response to a lengthening of these time intervals.

11 Claims, 4 Drawing Figures

METHOD AND APPARATUS FOR CENTRIFUGING SLUDGE-CONTAINING LIQUIDS

This invention relates to centrifugal separators of the type in which different components are separated from a liquid mixture, and accumulated solids ("sludge") are periodically discharged through ports in the bowl periphery. The invention also relates to a method of separating different components from a liquid mixture by means of a centrifugal separator.

In a separator of this type, it is usual for the sludge discharge to take place automatically in response to the sludge level reaching a predetermined position in the bowl. It is a well known phenomenon that when sludge discharge is effected, there is a substantial deceleration of the bowl and therefore a sharp increase in the load imposed upon the motor driving the bowl. This increase of motor load gives rise to heating of the motor windings; and providing that the discharge of the bowl does not take place too frequently, the motor windings are able to cool sufficiently between the sludge discharges to prevent the windings reaching a dangerously high temperature. However, if for any reason the frequency of discharges from the bowl increases, a dangerous heating of the motor windings can occur. The motor is invariably protected by a thermal overload switch, but operation of this switch causes a long delay, typically in the order of 3 to 6 hours, before the separator can be restarted.

One solution of this overheating problem is to ensure that the centrifuge is capable of handling (i.e., separating) a much larger volume of accumulated solids than is actually supplied to it most of the time. This has the disadvantage that for a large part of its operating time, the centrifuge is working at much less than its full capacity, which is wasteful and may not always solve the problem since the proportion of heavy components to be discharged from a fluid input to the separator can vary considerably.

An object of the present invention is to control the flow of material to the separator so as to avoid or at least mitigate the disadvantage of overheating.

The present invention provides a method of separating different components from a fluid mixture by means of a centrifugal separator; and this method comprises sensing when a predetermined amount of a separated heavy component has been collected within the centrifuge rotor, opening outlets at the periphery of the rotor in response to said sensing operation so that the separated heavy component is discharged, measuring the periods of time between consecutive sensing operations, and controlling the rate of flow of mixture to the separator in accordance with the measuring operation.

The centrifuge of the present invention serves to separate different components from a fluid mixture and comprises apparatus for automatically opening a plurality of outlets at the periphery of the centrifuge rotor, means for adjusting the rate of flow of mixture to the centrifuge rotor, means connected to said adjusting means for measuring the periods of time between accumulations of predetermined amounts of separated heavy material and for comparing said periods of time with a predetermined period of time, and means for controlling said adjusting means in accordance with a signal which is the result of said comparison.

In one embodiment, the apparatus is arranged to set a desired frequency of operation of the separator and to control the flow to the separator in order to achieve this. This embodiment thus overcomes the disadvantage of overheating by ensuring that the desired frequency of operation is lower than the frequency which would produce overheating and also, if the desired frequency is set at or near the upper frequency limit, allows the separator to be operated at maximum capacity.

Features and advantages of the invention will appear also from the following description of embodiments thereof, given by way of example, with reference to the accompanying drawings, in which.

Figure 4:
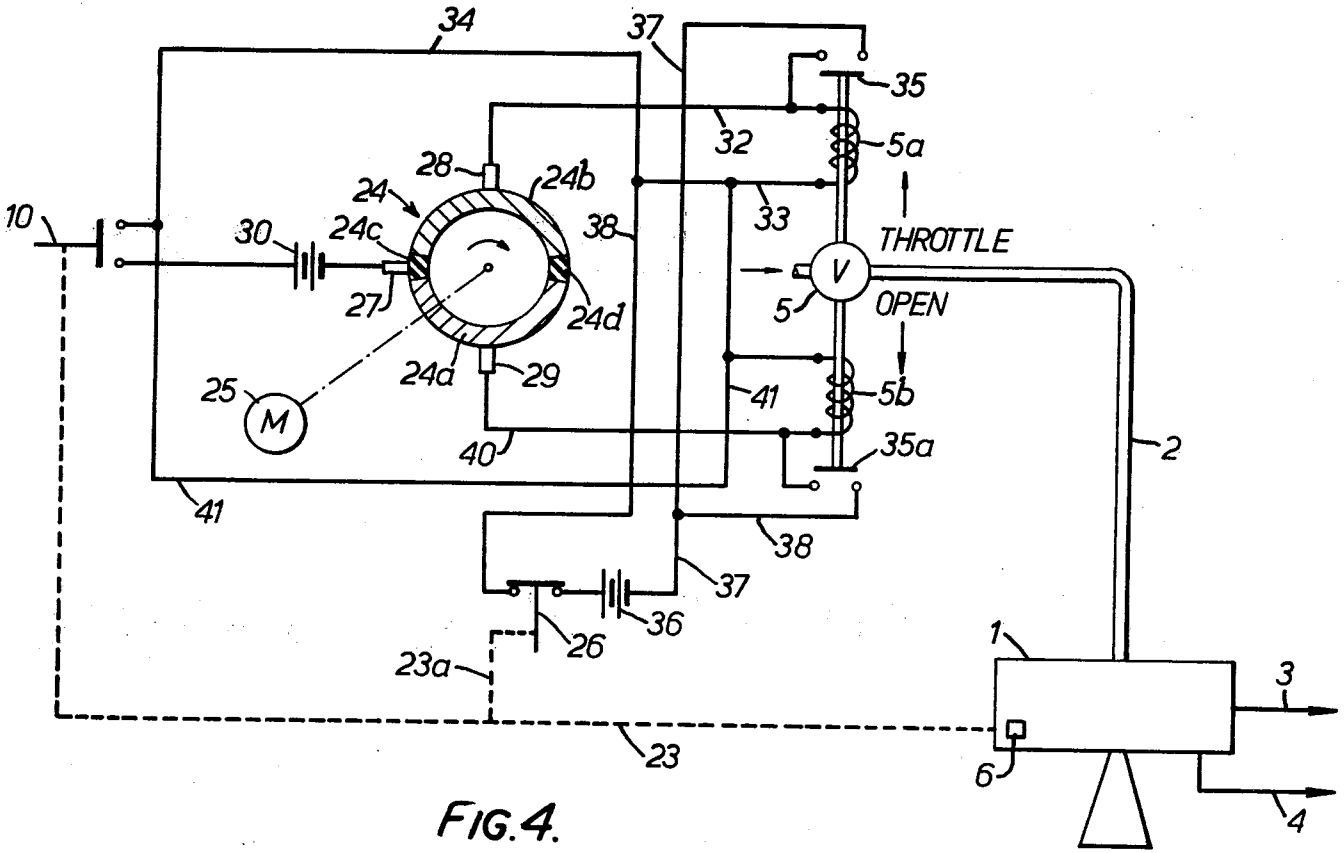
FIG. 4 is a schematic view of a centrifuge having simplified circuitry for controlling the feed valve.

A centrifugal separator is shown at 1 in FIG. 4 and comprises a supply conduit 2 for a flowing mixture to be centrifuged, an outlet conduit 3 for a separated heavy component (sludge) and an outlet conduit 4 for a separated light component. In the supply conduit 2 is an adjustable valve 5.

The centrifugal separator is of the kind in which the rotor has a number of outlets (not shown) at its periphery, which may be opened intermittently during operation for throwing out or "shooting" of the heavy component (sludge) that has been separated from the mixture supplied through the inlet conduit 2. The separator is provided with apparatus for automatically opening these sludge outlets when the separated sludge accumulating in the peripheral part of the rotor reaches a predetermined amount, as determined by means 6 for sensing when the sludge has accumulated to a certain level. Sludge centrifuges having such sensing means arranged to open the sludge outlets automatically are well known in the art, an example being disclosed in U.S. Pat. No. 3,408,000 granted Oct. 29, 1968.

Figure 1:
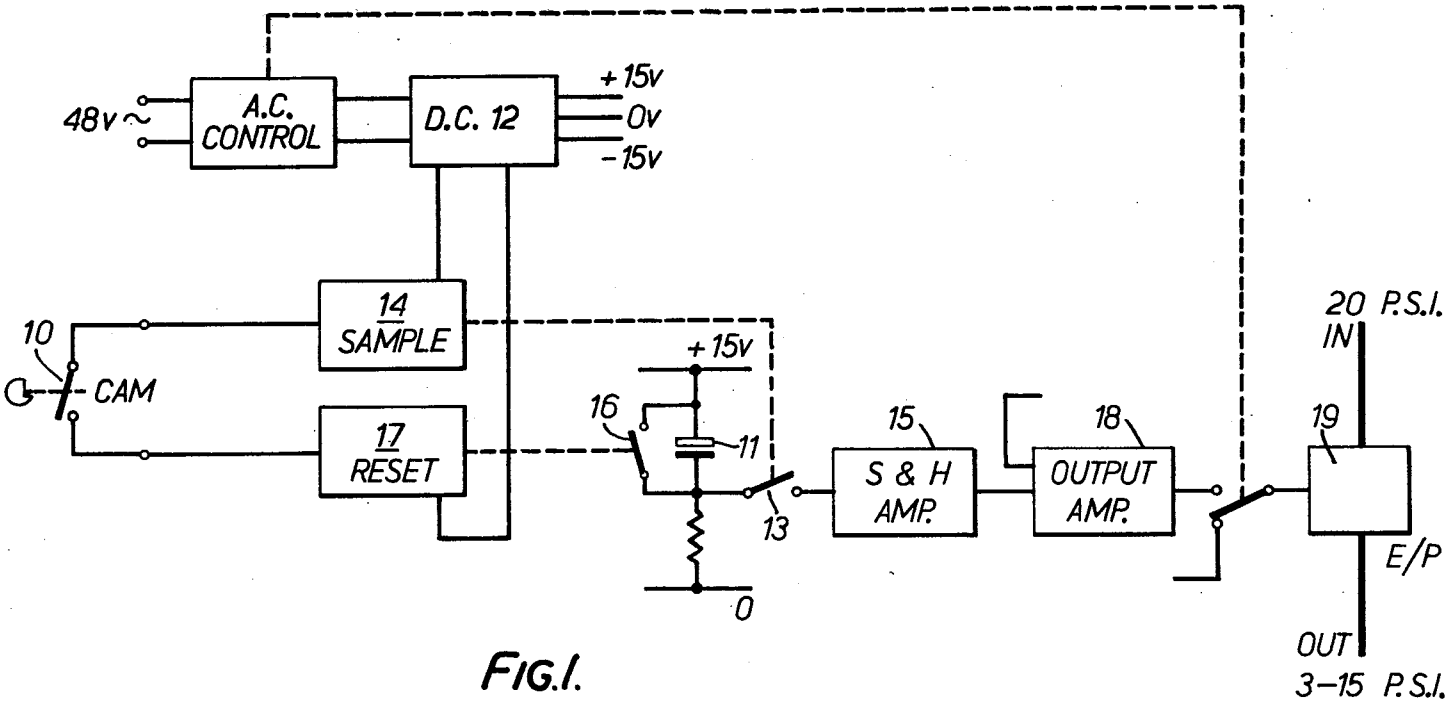
FIG. 1 is a block diagram of a separator control circuit.
Figure 2:
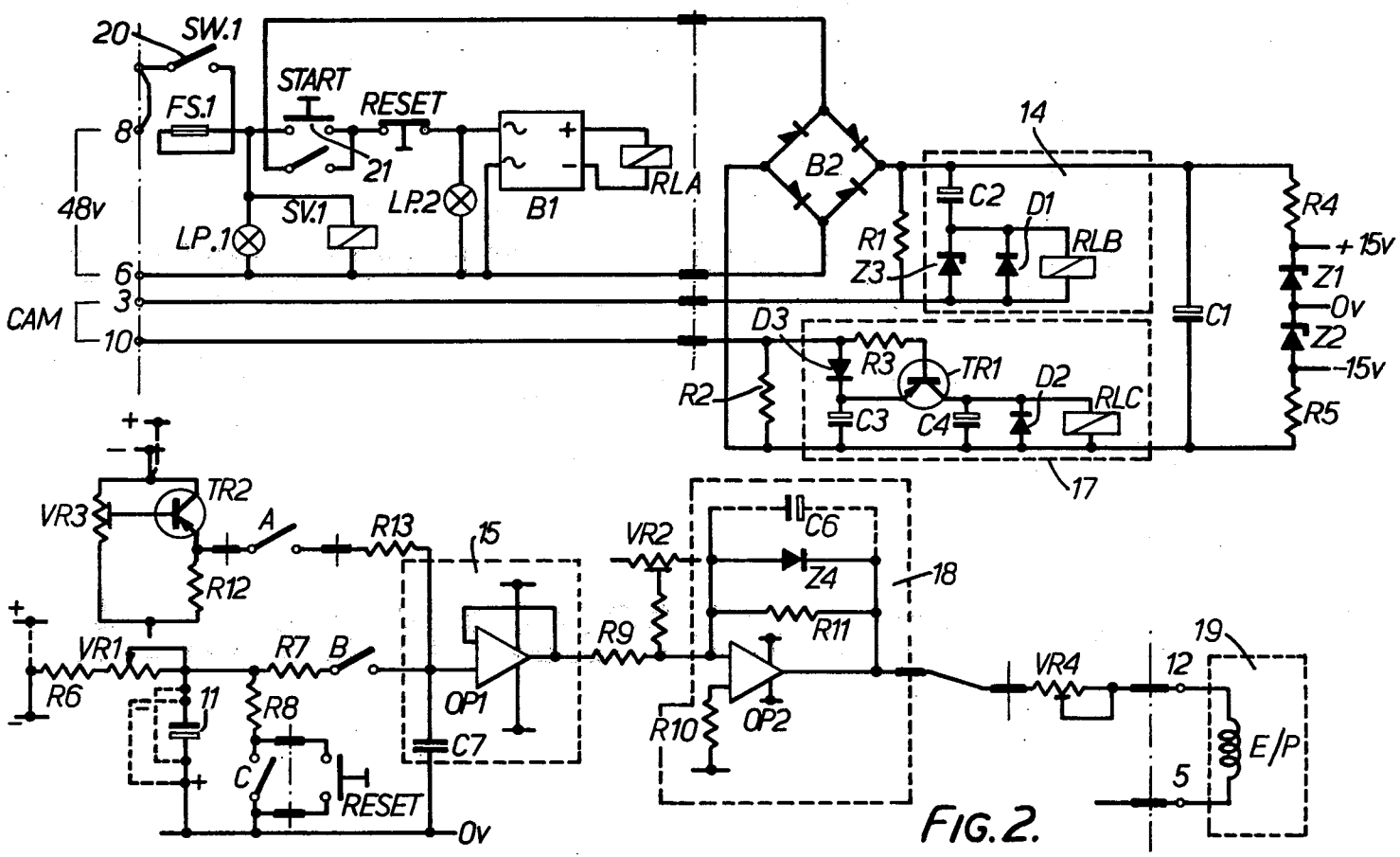
FIG. 2 is a circuit diagram of a control circuit shown in FIG. 1.

The control circuit shown in FIGS. 1 and 2 is adapted for use with a separator of the self-triggering type, such as described above and disclosed as an example in the above-mentioned patent.

Referring now to FIG. 1, the control unit provides a signal which starts a control sequence. In this embodiment the generation of this signal is represented by the closure of the cam-operated switch 10 which is assumed to operate each time the outlets in the periphery of the separator are opened to actually discharge the sludge when a predetermined amount of sludge has been collected. The time interval between these signals is monitored by the control circuit shown in FIGS. 1 and 2 and the input flow to the separator altered in consequence. To this end, the control circuit includes means for converting the frequency of signals to a voltage which is proportional to the frequency.

In this embodiment, the time interval between the signals is monitored by a capacitor 11, a charge on which is a function of the time between signals from the switch 10. The capacitor is charged from a stabilized direct current supply 12. Operation of the switch 10 causes a sampling switch 13 to be closed under the control of a monostable circuit 14, to transfer the charge on the capacitor 11 to a sample and hold amplifier 15. Since switch 13 operates every time sludge is discharged from the bowl, the frequency of discharge is thus converted to a voltage signal by the above apparatus. The capacitor 11 is then fully discharged by closing a further switch 16 under the control of a further monostable circuit 17.

An output amplifier 18 connected to the amplifier 15 converts the voltage signal from the amplifier 15 to a current output which is used to control the rate of flow of material to the separator by being fed to a suitable device, for example, an electrical to pneumatic converter 19 which in turn produces a pneumatic output for regulating the valve 5 in the feed line 2 to the separator (FIG. 4) or for regulating a control circuit for controlling the speed of a variable speed feed pump supplying the separator.

A more detailed circuit diagram is shown in FIG. 2, the blocks shown in FIG. 1 being indicated in broken lines. The operation of the control circuit will now be described in more detail with reference to FIGS. 2 and 3.

To operate the control circuit, a main switch 20 is closed which energizes the stabilized supply 12 and the start switch 21 is also operated. On first switching on the apparatus, operation of the start switch 21 causes energization of a relay RLA which causes relay contact A to close to feed a constant current signal to the sample and hold amplifier 15. It is arranged that the value of this constant current will lie between the maximum and minimum currents fed to the amplifier 15 from the capacitor 11 so that the rate of supply of sludge to the separator lies somewhere between the maximum and minimum values. The adjustment of the initial value is altered by variable resistor VR3.

The separator then begins to operate and when the first discharge of sludge occurs, the cam operated switch 10 is closed which causes both the monostable circuits 14 and 17 to be connected to a potential divider circuit formed by the resistors R1 and R2. As soon as the monostable circuit 14 is connected to the potential divider, the relay RLB is energized which closes contact B thus operating the switch 13 to transfer the voltage on the capacitor 11 to the sample and hold amplifier 15. Simultaneously, a capacitor C2 in the monostable circuit 14 starts to charge. The relay RLB is thus energized until the capacitor C2 is fully charged whereupon the relay contacts drop out. At the same time as the relay RLB in the monostable circuit 14 is energized, a transistor TR1 in the monostable circuit 17 is made conductive which causes a capacitor C4 in this circuit to accumulate charge. The time constant of the circuit 17 is arranged such that its relay RLC will be energized at the same time or immediately after the relay RLB is deenergized. When the relay RLC is energized its corresponding contacts C are closed to close the switch 16 which completely discharges the capacitor 11 ready for the next timing period.

The voltage which has been transferred to the capacitor C7 of the sample and hold amplifier 15, is fed to an inverting output amplifier 18 which is used to condition and limit the output signal to a 0-20 mA current signal which is a function of the voltage on the capacitor C7 and which is fed to the electrical to pneumatic converter 19.

Figure 3:
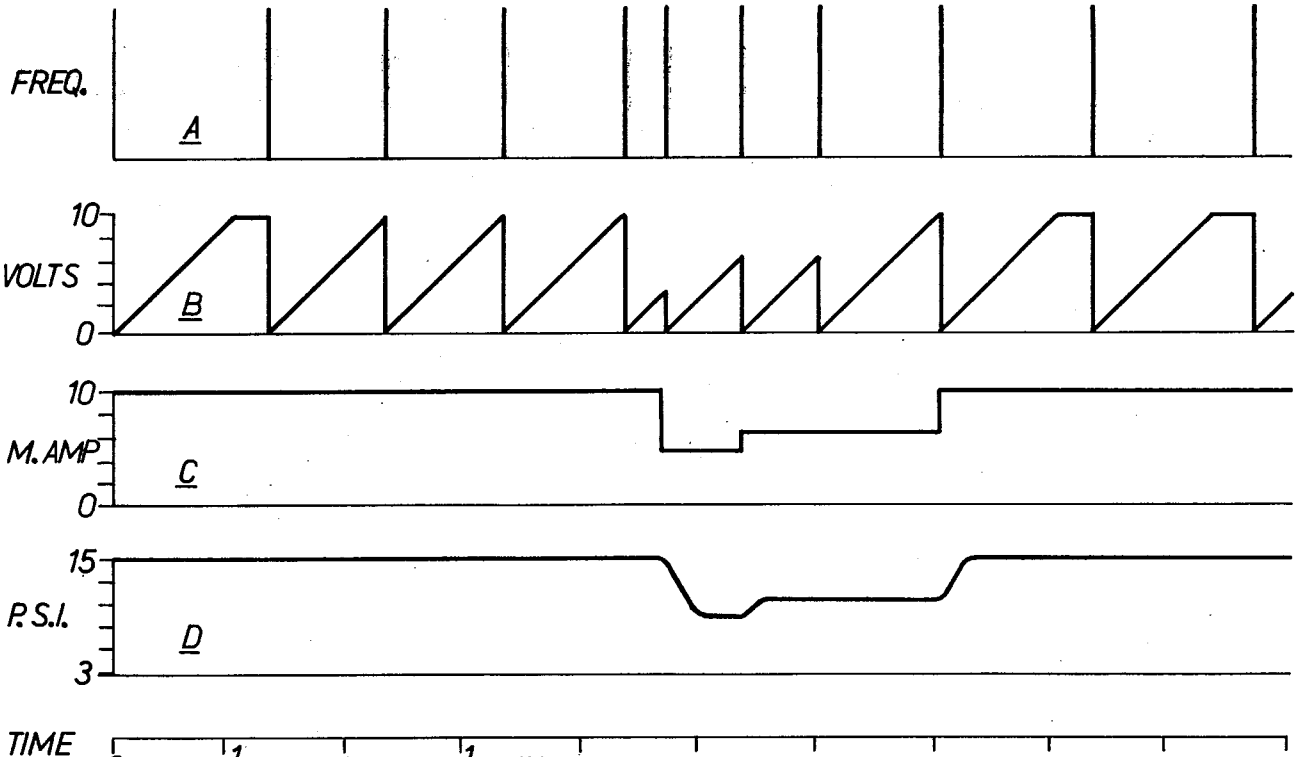
FIG. 3 shows typical wave forms obtained at different points of the control circuit.

Referring now to FIG. 3, it will be seen that waveform B shows the voltage on the capacitor 11, while waveform A shows the frequency of operation of the shooting mechanism of the separator. The rate at which the capacitor 11 accumulates charge is controlled by a variable resistor VR1 in its charging circuit. It is arranged that the capacitor 11 will reach full charge in the shortest time which it has been determined should occur between shooting of the sludge from the separator to avoid overheating which, for example, may be 1½ minutes, but by varying the setting of the variable resistor VR1 the time constant of the charging circuit can be varied, in this instance in the range from 20 seconds to 3 minutes. If discharges of sludge take place at intervals greater than 1½ minutes, the voltage on the capacitor 11 is ten volts; if the discharges of sludge take place at intervals of less than 1½ minutes the voltage on the capacitor 11 is correspondingly reduced. The supply of material to the separator is reduced as a function of this reduced voltage. This will be clearly seen by comparing the waveforms in FIG. 3.

Waveform C shows the output from the output amplifier 18 from which it will be seen that due to the sample and hold amplifier 15 the output from the amplifier 18 is constant at 10 milliamps as long as the frequency of discharge from the separator is equal to or lower than the desired frequency which has been set by the variable resistor VR1. Waveform D shows the output from the electrical to pneumatic converter 19. It will be noted that the sharp corners have been eliminated so that the apparatus will function smoothly. This rounding of the corners is carried out in the amplifier 18 by virtue of the feedback components R11, Z4 and C6. In waveform C it is assumed that the base line is at 0 mA. This can be altered by changing the setting of the variable resistor VR2 to provide an offset which can be at any value between 0 mA and 10 mA.

The above circuit sets the limit of the maximum frequency of operation of the separator and thus avoids the problems of overheating discussed previously. It does not limit the minimum frequency of operation.

The above circuit can be modified in order to set the frequency of operation at any desired frequency, preferably at the maximum frequency of operation so that the separator can be used at maximum capacity during substantially all of the separating operation. This can be achieved by ensuring that the frequency to voltage converter described previously can sense frequencies which are both above and below the desired frequency of operation and also that the flow of material to the separator can be regulated sufficiently to ensure that the sludge accumulates in the separator at a rate sufficient to ensure that the existing automatic discharging apparatus will operate at the desired frequency.

With reference to FIG. 2, assume that the desired frequency is such that the period between actuations of the automatic discharging apparatus will tend to be constant at one and a half minutes as before. The variable resistor VR1 is then adjusted so that the capacitor will not fully charge in 1½ minutes. Also the output amplifier is modified by replacing the resistor R10 by a variable resistor connected to a positive supply of voltage. The setting of this variable resistor will determine the frequency of operation of the separator since it will apply a reference signal to the output amplifier against which the signal from the sample and hold amplifier 15 which is indicative of the actual frequency of operation of the separator will be compared.

The output from the output amplifier will again operate a suitable device to regulate the flow of material to the separator and further description of this is not considered necessary. The above modification thus provides the facility for regulating the frequency of operation to achieve maximum utilization of the equipment when the frequency of operation is set at that frequency which just overcomes the problems of overheating.

Referring now to FIG. 4, the feed rate to centrifuge 1 is controlled by two solenoids 5*a* and 5*b*. Energizing of solenoid 5*a* throttles valve 5 so as to reduce the feed rate, and energizing of solenoid 5*b* opens valve 5 wider so as to increase the feed rate. Upon deenergizing of either solenoid, valve 5 automatically returns to its central position where it provides a normal feed rate.

Through an operative connection 23 from the sludge sensing means 6, switch 10 is closed momentarily each time the separated sludge accumulates to a predetermined level (amount) in the rotor of centrifuge 1. Each time interval between consecutive closings of switch 10 is measured in the sense that it is compared with a fixed time interval provided by a rotary cylinder 24 driven clockwise at constant speed by a motor 25. The cylinder has two arcuate conducting portions 24*a* and 24*b* separated by diametrically opposed insulators 24*c* and 24*d*. Stationary electrical contacts 27, 28 and 29 slide on the periphery of cylinder 24 as it rotates.

Through a branch 23*a*, the operative connection 23 momentarily opens a switch 26 whenever switch 10 is momentarily closed. However, the latter switch has a slightly delayed reopening so that it remains closed for a moment after switch 26 has reclosed.

In the operation of the control arrangement in FIG. 4, the speed of motor 25 is adjusted so that the time required for cylinder 24 to make one complete revolution is about equal to the desired time interval between consecutive closings of switch 10 (i.e., between consecutive openings of the sludge outlets under control of sensing means 6). As long as this desired time interval prevails, the insulator 24*c* will be in engagement with contact 27 (as shown in FIG. 4) each time switch 10 is closed momentarily, so that no current can flow from current source 30. Valve 5 will therefore remain in its central position to continue the normal feed rate to centrifuge 1.

Assume a significant increase in the sludge content of the feed through valve 5, so that separated sludge accumulates more rapidly in the peripheral part of the centrifuge rotor. This will shorten the time interval between successive closings of switch 10, whereby contact 27 will be engaging the cylinder's conductive segment 24*b* when switch 10 closes momentarily. The result is to establish a circuit from the negative side of current source 30 through the parts 27-24*b*-28, wire 32, solenoid 5*a*, wires 33 and 34, and switch 10 to the positive side of source 30. Solenoid 5*a* is thus energized to throttle valve 5 and simultaneously close a switch 35, thereby establishing a holding circuit from the negative side of a current source 36 through wire 37, switch 35, solenoid 5*a*, wires 33 and 38, to the positive side of source 36 by way of switch 26, which will have reclosed before reopening of switch 10. Consequently, valve 5 will remain throttled by solenoid 5*a* until the sensing means 6 signals that the sludge has again accumulated to the predetermined level in centrifuge 1, at which time swich 26 is momentarily opened to break the aforementioned holding circuit.

This period of throttling the valve 5 has the effect of delaying the sludge-sensing signal from sensing means 6. If this delay is such that contact 27 now engages insulator 24*c* when switch 10 is next momentarily closed, the aforementioned holding circuit remains broken so as to deenergize solenoid 5*a*, whereby valve 5 returns to its central position to restore the normal feed rate. On the other hand, if this delay is insufficient to restore the normal feed rate, contact 27 will again be engaging conductive segment 24*b* when switch 10 closes momentarily, thereby reenergizing solenoid 5*a* and its holding circuit so that valve 5 is again throttled at least until the next signal from sensing means 6. Thus, valve 5 will be controlled automatically to at least largely counteract an increased sludge content of the feed and to restore the feed to its normal rate when its sludge content drops back to normal.

If the sludge content of the feed decreases significantly from its normal value, the time interval between successive closings of switch 10 will increase, so that contact 27 will be engaging the conductive segment 24*a* when switch 10 closes momentarily. This establishes a circuit from the negative side of source 30 through the parts 27-24*a*-29, wire 40, solenoid 5*b*, wire 41, and switch 10 to the positive side of source 30. Solenoid 5*b* is thus energized to open valve 5 wider and simultaneously close a switch 35*a*, thereby establishing a holding circuit from the negative side of source 36 through wires 37 and 38, switch 35*a*, solenoid 5*b*, wires 41, 33 and 38, and switch 26 to the positive side of current source 36. Consequently, valve 5 will remain in its wider-opening position until sensing means 6 signals that the separated sludge has again accumulated to the predetermined level, at which time switch 26 is momentarily opened to break the last-mentioned holding circuit. Thereafter, solenoid 5*b* will either be deenergized or remain energized, depending upon the position of insulator 24*c* when switch 10 is momentarily closed, so that the operation is similar to that described in connection with solenoid 5*a*.

As shown in FIG. 4, the insulator 24*c* is wider than contact 27, so that the time period between consecutive closings of switch 10 can vary to a minor degree from the desired time period (as determined by the speed setting of motor 25) without affecting valve 5. Of course, the degree of this minor tolerance can be varied by varying the width of insulator 24*c*.

We claim:

1. In the separation of different components from a fluid mixture by means of a centrifugal separator, the method which comprises feeding the mixture into the rotor of said separator, sensing when a predetermined amount of a separated heavy component has been collected within the rotor, opening outlets at the periphery of the rotor in response to each said sensing operation so that the separated heavy component is discharged, measuring the actual period of time between consecutive sensing operations, and controlling the rate of the mixture feed to the separator as a function of the measuring operation.

2. The method of claim 1, which comprises also determining the maximum desired frequency of opening the outlets of the separator, the feed rate of mixture to the separator being controlled so that the maximum frequency of opening the outlets will not be exceeded.

3. The method of claim 1, which comprises also determining the desired frequency of opening the outlets of the separator, the feed rate of mixture to the separator being controlled as a function of the measuring operation so that the frequency of opening the outlets will be maintained at substantially said desired frequency.

4. The method of claim 1, in which said measuring operation is effected by comparing said actual time period with a predetermined time period, said controlling of the feed rate being effected by reducing the feed rate in response to a shortening of the actual time period relative to the predetermined time period and by increasing the feed rate in response to a lengthening of the actual time period relative to the predetermined time period.

5. In combination with a centrifugal separator for separating different components from a fluid mixture and including a centrifugal rotor having a plurality of normally closed outlets at its periphery, means for automatically opening said outlets, means for adjusting the rate at which the mixture is fed to the centrifugal rotor, means for measuring the actual period of time between consecutive accumulations of predetermined amounts of separated heavy material in the rotor and for comparing said period of time with a predetermined period of time, and means for controlling said adjusting means in accordance with a signal which is the result of said comparison.

6. The combination of claim 5, wherein said measuring means comprises a converter circuit for producing a signal the magnitude of which is a function of the frequency of signals indicative of accumulations of predetermined amounts of separated heavy material.

7. The combination according to claim 6, wherein said converter circuit is a frequency to voltage converter circuit.

8. The combination according to claim 6, wherein said converter circuit comprises a capacitor, the accumulation of charge on which is representative of said frequency.

9. The combination according to claim 8, wherein the converter circuit is arranged so that the maximum voltage on the capacitor represents the predetermined period of time and is indicative of the maximum frequency of operation of said automatic outlet opening means.

10. The combination according to claim 8, wherein said measuring means comprises means for producing a reference signal indicative of a desired frequency of operation of said automatic outlet opening means, and means for comparing said reference signal with the voltage from said capacitor.

11. A control circuit for controlling the operation of a centrifugal separator of the type having means for automatically opening a plurality of outlets at the periphery of the centrifuge rotor, the circuit comprising means for producing a signal indicative of the time interval between consecutive accumulations of predetermined amounts of separated heavy material in said rotor, means for comparing said signal with a reference signal representative of a desired time interval, and means responsive to said comparing means for producing an output signal for controlling flow of material to said separator.

* * * * *